US006328817B1

(12) United States Patent
Murakami

(10) Patent No.: US 6,328,817 B1
(45) Date of Patent: Dec. 11, 2001

(54) POWDER FOR PERMANENT MAGNET, METHOD FOR ITS PRODUCTION AND ANISOTROPIC PERMANENT MAGNET MADE USING SAID POWDER

(75) Inventor: Ryo Murakami, Akashi (JP)

(73) Assignee: Santoku Metal Industry Co., Ltd., Kobe (JP)

( * ) Notice: Subject to any disclaimer, the term of this patent is extended or adjusted under 35 U.S.C. 154(b) by 0 days.

(21) Appl. No.: 09/284,446

(22) PCT Filed: Nov. 4, 1997

(86) PCT No.: PCT/JP97/04012

§ 371 Date: Apr. 12, 1999

§ 102(e) Date: Apr. 12, 1999

(87) PCT Pub. No.: WO98/20507

PCT Pub. Date: May 14, 1998

(30) Foreign Application Priority Data

Nov. 6, 1996 (JP) ..... 8-294049

(51) Int. Cl.[7] ..... H01F 1/01

(52) U.S. Cl. ..... 148/105; 148/513; 427/216; 427/217; 419/20; 419/35

(58) Field of Search ..... 148/302, 513, 148/105, 206, 108, 122; 419/35, 20; 427/213.3, 216, 217; 75/246, 232; 428/403, 404

(56) References Cited

U.S. PATENT DOCUMENTS

| | | | | |
|---|---|---|---|---|
| 4,165,232 | * | 8/1979 | Jaeckh et al. | 75/0.5 AA |
| 5,183,515 | * | 2/1993 | Ueno et al. | 148/101 |
| 5,453,137 | * | 9/1995 | Takahashi | 148/306 |
| 5,728,232 | * | 3/1998 | Takahashi | 148/105 |
| 5,766,372 | * | 6/1998 | Fujimura et al. | 148/101 |
| 5,840,375 | * | 11/1998 | Katsumi et al. | 427/600 |

FOREIGN PATENT DOCUMENTS

| | | | |
|---|---|---|---|
| 07166203 | 6/1995 | (JP) . | |
| 7-272913 | 10/1995 | (JP) | H01F/1/06 |

* cited by examiner

*Primary Examiner*—Daniel J. Jenkins
(74) *Attorney, Agent, or Firm*—Marshall, Gerstein & Borun

(57) ABSTRACT

There is provided a powder for permanent magnet comprising needle-like fine particles of Fe or Fe—Co alloy as a base material, a hard magnetic layer and a separation layer of an oxide of rare earth element provided outside said hard magnetic layer.

13 Claims, 2 Drawing Sheets

POWDER FOR PERMANENT MAGNET, METHOD FOR ITS PRODUCTION AND ANISOTROPIC PERMANENT MAGNET MADE USING SAID POWDER

TECHNICAL FIELD

The present invention relates to a bonded permanent magnet material used in a motor, a speaker, an actuator or the like and directs to an exchange spring magnet having a composite structure of a hard magnetic phase represented by $Sm_2Fe_{17}N_x$ and a soft magnetic phase of Fe or Fe—Co alloy or the like in the same texture, and it also relates to a novel powder for permanent magnet with well-balanced high magnetization and high coercive force, a method for producing the powder and an anisotropic permanent magnet made by the powder.

BACKGROUND ART

An exchange spring magnet behaves as a single hard magnetic material because of strong exchange bonding force between both phases described above and, at the same time, it exhibits such a specific behavior that magnetization reversibly springs back to a change of an external magnetic field in the second quadrant of a demagnetization curve. Recently, an optimum use of the effect has attracted special interest.

A suggested method of allowing a soft magnetic phase to exist in an alloy for magnet is roughly divided into two ways. The method belonging to the first division is a method of causing the soft magnetic phase separation as a result of p precipitation from a molten alloy with a controlled composition on solidification during cooling or the following heat treatment after cooling, and includes various methods, for example, a method described in Unexamined Patent Publication No. Hei 5-135928 wherein a Nd—Fe—B alloy containing excess Fe is molten, solidified and heat-treated to obtain a micro-crystal aggregate of a $Fe_3$ B phase (soft magnetic phase) and a $Nd_2$ $Fe_{14}$ B phase (hard magnetic layer), or a method described in Unexamined Patent Publication No. Hei 6-330252 wherein a Sm—Fe—N alloy containing excess Fe is molten, solidified and heat-treated, thereby allowing to make a Fe phase (soft magnetic phase) and a $Sm_2Fe_{17}N_x$ phase (hard magnetic layer) coexist as a crystal having a grain size of not more than 0.5 $\mu$m, respectively. However, these alloys obtained by these methods can be used only as an isotropic magnet alloy and have such disadvantages that there is a limitation in characteristics for novel use in future and that expensive and large-scale equipment for melting and quenching solidification of the alloy are required.

The method belonging to the second division is a method of using needle-like iron powder as a base material and changing the surface portion into a hard magnetic phase by using a chemical treatment and a heat treatment. Unexamined Patent Publication No. Hei 7-272913 discloses a raw material for permanent magnet, comprising needle-like iron powder, an aluminum phosphate coating layer, a rare earth diffusion layer or a rare earth-iron-boron diffusion layer or a rare earth-boron-nitrogen diffusion layer, and an aluminum phosphate coating layer, said layers being provided in order on the surface of the needle-like iron powder, and also discloses a method for producing the raw material, which comprises the steps of heating FeOOH (Goethite) needle-like grains under the state of being coated with aluminum phosphate in a hydrogen atmosphere to 300–500° C., thereby reducing FeOOH to Fe (needle-like iron powder); heating to 650–1000° C. in an argon atmosphere under the presence of rare earth or rare earth and boron, thereby diffusing rare earth, or rare earth and boron on the surface of the aluminum phosphate-coated needle-like iron powder; heating to 500–300° C. in a nitrogen atmosphere, thereby diffusing nitrogen on the surface layer; and heating to 300–500° C in an argon atmosphere, thereby coating with aluminum phosphate again. According to this method, magnetic characteristics are improved by the oxidizing inhibition effect due to double coating of aluminum phosphate and the action as a magnetic domain wall thereof, but stable excellent magnetic characteristics can not be obtained. This reason is as follows. That is, during the evaporation and diffusion of Sm, aluminum phosphate is decomposed and reduced by a strong reducing force of Sm and Al is incorporated into the iron powder, whereas, Sm is oxidized and the hard magnetic phase of the Sm—Fe—N alloy is not easily formed, resulting in deterioration of magnetic characteristics.

More particularly, the present invention relates to an improvement in exchange spring magnet by using the method belonging to the second division, and an object of the present invention is to provide a powder for permanent magnet having stable excellent magnetic characteristics by homogeneously diffusing and forming a hard magnetic layer on the surface of needle-like Fe fine particles, a method for producing the powder, and an anisotropic permanent magnet made by the powder.

DISCLOSURE OF INVENTION

To attain the object described above, the powder for permanent magnet according to the present invention, comprises needle-like fine particles of Fe or Fe—Co alloy as a base material, a hard magnetic layer containing Fe, Sm and N provided on the surface of said needle-like fine particles, and a separation layer of an oxide of rare earth element provided outside said hard magnetic layer. By having such a separation layer, the respective needle-like fine particles are separated and adhesion between the needle-like fine particles and grain growth are inhibited, thereby inhibiting a reduction in aspect ratio. As a result, a permanent magnet having excellent shape anisotropy can be obtained.

Furthermore, the powder for permanent magnet of the present invention comprises a sintered body powder having a particle diameter of 10 to 100 $\mu$m, said sintered body powder comprising needle-like fine particles of Fe or Fe—Co alloy as a base material, a hard magnetic layer containing Fe, Sm and N provided on the surface of said needle-like fine particles, and a separation layer of an oxide of rare earth element provided outside said hard magnetic layer. By using such a separation layer, bonding of iron phases is inhibited on sintering, thereby making it possible to obtain a well-dispersed high-density sintered body.

Furthermore, when the separation layer is coated with one or more metals of Zn, Sn and Pb, an intermetallic compound is formed between Sm and these low-melting point metals, thereby markedly improving a coercive force.

In the present invention, a first invention provides a powder for permanent magnet, comprising needle-like fine particles of Fe or Fe—Co alloy as a base material, a hard magnetic layer containing Fe, Sm and N provided on the surface of said needle-like fine particles, and a separation layer of an oxide of rare earth element provided outside said hard magnetic layer. As the rare earth elements, one or more rare earth elements of Nd, La, Ce, Pr, Sm and Y can be used.

Furthermore, a second invention provides a powder for permanent magnet, comprising a sintered body powder having a particle diameter of 10 to 100 μm, said sintered body powder comprising needle-like fine particles of Fe or Fe—Co alloy as a base material, a hard magnetic layer containing Fe, Sm and N provided on the surface of said needle-like fine particles, and a separation layer of an oxide of a rare earth element provided outside said hard magnetic layer.

In the first invention, a third invention provides a powder for permanent magnet wherein a separation layer is coated with one or more metals of Zn, Sn and Pb.

To produce the powder for permanent magnet described above, a fourth invention provides a method for producing a powder for permanent magnet, which comprises coating the surface of needle-like Fe fine particles or needle-like Fe—Co alloy fine particles, said fine particles having a major axis of 0.1 to 3 μm and a minor axis of 0.03 to 0.4 μm, with a hydroxide of rare earth element by using wet deposition method; subjecting the fine particles to filtration and drying; heat- treating the dried fine particles in an atmosphere of a hydrogen gas or an inert gas, or a mixture thereof; coating the resultant needle-like Fe fine particles or needle-like Fe—Co alloy fine particles coated with an oxide of rare earth element with Sm in a vacuum at a temperature of 500 to 1000° C.; further heat-treating the fine particles to form a compound layer containing Fe and Sm on the surface of the needle-like Fe fine particles or needle-like Fe—Co alloy fine particles; and subjecting the heat-treated fine particles to a nitriding treatment in a nitrogen-containing gas.

As another producing method, a fifth invention provides a method for producing a powder for permanent magnet, which comprises coating the surface of α-FeOOH needle-like fine particles or α-FeOOH needle-like fine particles doped with Co, said fine particles having a major axis of 0.1 to 3 μm and a minor axis of 0.03 to 0.4 μm, with a hydroxide of rare earth element by using wet deposition method; subjecting the fine particles to filtration and drying; heat-treating the dried fine particles in an atmosphere of a hydrogen-containing gas; coating the resultant needle-like Fe fine particles or needle-like Fe—Co alloy fine particles coated with an oxide of rare earth element with Sm in a vacuum at a temperature of 500 to 1000° C.; further heat-treating the fine particles to form a compound layer containing Fe and Sm on the surface of the needle-like Fe fine particles or needle-like Fe—Co alloy fine particles; and subjecting the heat-treated fine particles to a nitriding treatment in a nitrogen-containing gas.

As still another producing method, a sixth invention provides a method for producing a powder for permanent magnet, which comprises coating the surface of needle-like Fe fine particles or needle-like Fe—Co alloy fine particles, said fine particles having a major axis of 0.1 to 3 μm and a minor axis of 0.03 to 0.4 μm, with a hydroxide of rare earth element by using wet deposition method; subjecting the fine particles to filtration and drying; heat-treating the dried fine particles in an atmosphere of a hydrogen gas or an inert gas, or a mixture thereof; coating the resultant needle-like Fe fine particles or needle-like Fe—Co alloy fine particles coated with an oxide of rare earth element with Sm in a vacuum at a temperature of 500 to 1000° C.; further heat-treating the fine particles to form a compound layer containing Fe and Sm on the surface of the needle-like Fe fine particles or needle-like Fe—Co alloy fine particles; compressing the needle-like fine particle in a magnetic field; sintering the compressed article at a temperature of 700 to 1000° C.; grinding the sintered one into particles having a particle diameter of 10 to 100 μm; and subjecting the particles to a nitriding treatment in a nitrogen-containing gas.

As a further producing method, a seventh invention provides a method for production of a powder for permanent magnet, which comprises coating the α-FeOOH needle-like fine particles or α-FeOOH needle-like fine particles doped with Co, said fine particles having a major axis of 0.1 to 3 μm and a minor axis of 0.03 to 0.4 μm, with a hydroxide of rare earth element by using wet deposition method; subjecting the fine particles to filtration and drying; heat-treating the dried fine particles in an atmosphere of a hydrogen-containing gas; coating the resultant needle-like Fe fine particles or needle-like Fe—Co alloy fine particles coated with an oxide of rare earth element with Sm in a vacuum at a temperature of 500 to 1000° C.; further heat-treating the fine particles to form a compound layer containing Fe and Sm on the surface of the needle-like Fe fine particles or needle-like Fe—Co alloy fine particles; compressing the needle-like fine particle in a magnetic field; sintering the compressed article at a temperature of 700 to 1000° C.; grinding the sintered article into particles having a particle diameter of 10 to 100 μm; and subjecting the particles to a nitriding treatment in a nitrogen-containing gas.

In the fourth or fifth invention, an eighth invention provides a method for producing a powder for permanent magnet, wherein a treatment of coating the surface with one or more metals of Zn, Sn and Pb is conducted after the nitriding treatment.

As a permanent magnet made by the powder for permanent magnet described above, a ninth invention provides an anisotropic permanent magnet which is obtained by kneading a powder for permanent magnet comprising needle-like fine particles of Fe or Fe—Co alloy as a base material, a hard magnetic layer containing Fe, Sm and N provided on the surface of said needle-like fine particles, and a separation layer of an oxide of rare earth element provided outside said hard magnetic layer, with a resin; and hot-pressing the mixture in a magnetic field.

As another permanent magnet, a tenth invention provides an anisotropic permanent magnet which is obtained by kneading a powder for permanent magnet comprising a sintered body powder having a particle diameter of 10 to 100 μm, said sintered body powder comprising needle-like fine particles of Fe or Fe—Co alloy as a base material, a hard magnetic layer containing Fe, Sm and N provided on the surface of said needle-like fine particles, and a separation layer of an oxide of rare earth element provided outside said hard magnetic layer, with a resin; and hot-pressing the mixture in a magnetic field.

As still another permanent magnet, an eleventh invention provides an anisotropic permanent magnet which is obtained by kneading a powder for permanent magnet comprising needle-like fine particles of Fe or Fe—Co alloy as a base material, a hard magnetic layer containing Fe, Sm and N provided on the surface of said needle-like fine particles, and a separation layer of an oxide of rare earth element provided outside said hard magnetic layer, the separation layer being coated with one or more metals of Zn, Sn and Pb, with a resin; and hot-pressing the mixture in a magnetic field.

As a further permanent magnet, a twelfth invention provides an anisotropic permanent magnet which is obtained by hot-pressing a powder for permanent magnet, comprising needle-like fine particles of Fe or Fe—Co alloy as a base material, a hard magnetic layer containing Fe, Sm and N provided on the surface of said needle-like fine particles, and a separation layer of an oxide of rare earth element provided outside said hard magnetic layer, the separation layer being coated with one or more metals of Zn, Sn and Pb, using the metal as a binder.

In the present invention, the major axis and the minor axis of the needle-like fine particles of Fe or Fe—Co alloy are adjusted to 0.1–3 μm and 0.03–0.4 μm, respectively, and the aspect ratio is preferably adjusted to not less than 2 so as to exert shape anisotropy. However, when the aspect ratio exceeds 15, twin is produced and the fluidity of the fine particles is poor, resulting in difficult handling. When the minor axis is smaller than 0.03 μm, it is difficult to control the thickness of the Sm diffusion layer in the formation of the following Fe—Sm compound layer and, therefore, stable magnetic characteristics can not be obtained. On the other hand, when the minor axis exceeds 0.4 μm, the thickness of remaining Fe (soft phase) after diffusion is too large and, therefore, magnetic characteristics are deteriorated. The method for producing the needle-like Fe fine particles includes, for example, reducing method using FeOOH as a raw material, electro-deposition method or the like.

As the element constituting the separation layer, rare earth element or CaO is preferable. Among the rare earth element, Pr or Nd can be preferably used in view of the adhesion. The purpose of forming the separation layer lies in separating the needle-like fine particles as described above, resulting in inhibition of reduction of the aspect ratio. To attain such a purpose of forming the separation layer, it is preferable that the element constituting the separation layer has larger affinity for oxygen than that of the element constituting the hard magnetic layer. To prevent delamination during the heat treatment step, it is preferable that the separation layer has high adhesion.

It is not important to coat the whole surface of needle-like fine particles of Fe or Fe—Co alloy with a separation layer of an oxide of rare earth element having a fixed thickness, but it is important to form a porous separation layer by using the oxide of rare earth element in the form of fine particles. Consequently, deposition of Sm homogeneously proceeds to form a homogeneous hard magnetic layer on the needle-like fine particles of Fe or Fe—Co alloy.

The method for forming the separation layer includes, for example, a method of adding a salt of rare earth element to a suspension of FeOOH needle-like fine particles, needle-like Fe fine particles or Fe—Co alloy needle-like fine particles, further adding $NH_4$ OH or the like to alkalify the solution, and depositing a hydroxide of rare earth element on the surface of the above needle-like fine particles, thereby coating the surface with the separation layer of an oxide of rare earth element. As this wet deposition method, the known methods such as normal addition, reverse addition, simultaneous addition, gas precipitation method, water- heat treatment method, coprecipitation method and the like can be used. It is not preferable to add KOH and NaOH when the solution is alkalified because a salt of K or Na is remained on the needle-like Fe fine particles, resulting in deterioration of corrosion resistance of the magnet. The resultant hydroxide layer is decomposed by the following heat treatment, thereby changing into a porous oxide layer.

The thickness of the Fe—Sm compound to be formed on the surface of the needle-like Fe fine particles or Fe—Co needle-like fine particles is from 0.01 to 0.1 μm, preferably from 0.02 to 0.08 μm, and more preferably from 0.02 to 0.05 μm, in terms of the total thickness of both sides. When the thickness of the iron fine particles exceeds 0.2 μm in the direction of short axis, the magnetic domain wall is present in a stable state and the coercive force is drastically lowered.

The nitriding treatment lies in formation of a hard magnetic layer represented by $Sm_2Fe_{17}N_x$ (X is about 3) by the introduction of N into the Fe—Sm compound layer, and is conducted by a heat treatment at a temperature of 400~600° C. in a nitrogen gas, an ammonia gas, or a nitrogen-containing gas prepared by adding a hydrogen gas to said gas.

When the separation layer is coated with one or more metals of Zn, Sn and Pb, an intermetallic compound of Sm of the hard magnetic layer and the low-melting point metal is produced and the coercive force is markedly improved. However, since the low-melting point metal such as Zn, Sn, Pb or the like is non-magnetic, when the thickness of coating of the low-melting point metal exceeds 0.3 μm, the value of magnetization is drastically lowered. On the other hand, when the thickness of coating of the low-melting point metal is smaller than 0.01 μm, an effect of improving the coercive force is not obtained.

Furthermore, in case where the powder for permanent magnet comprising the sintered body powder as the second invention is obtained by the producing method as the six invention, when the sintering temperature is lower than 700° C., the density is not increased. On the other hand, when the sintering temperature exceeds 1000° C., coarsening of particles occurs, resulting in deterioration of magnetic characteristics. When a sintered body powder is obtained by grinding sintered needle-like fine particles, it is preferable that the sintered needle-like fine particles are ground into pieces having a particle diameter of 10 to 100 μm. When the particle diameter is smaller than 10 μm, high orientation is not easily obtained. On the other hand, when the particle diameter is larger than 100 μm, the pressurized powder density is lowered.

According to the present invention as described above, there can be provided a powder for permanent magnet having stable excellent magnetic characteristics by homogeneously diffusing and forming a hard magnetic layer on the surface of needle-like Fe fine particles, a method for producing the powder, and an anisotropic permanent magnet made by the powder.

BEST MODE FOR CARRYING OUT THE INVENTION

The respective steps from a starting material to a magnet formed by the following steps will be explained in order as Embodiments of the present invention.

1. Production of Magnet by Low Temperature Forming

Figure 1:
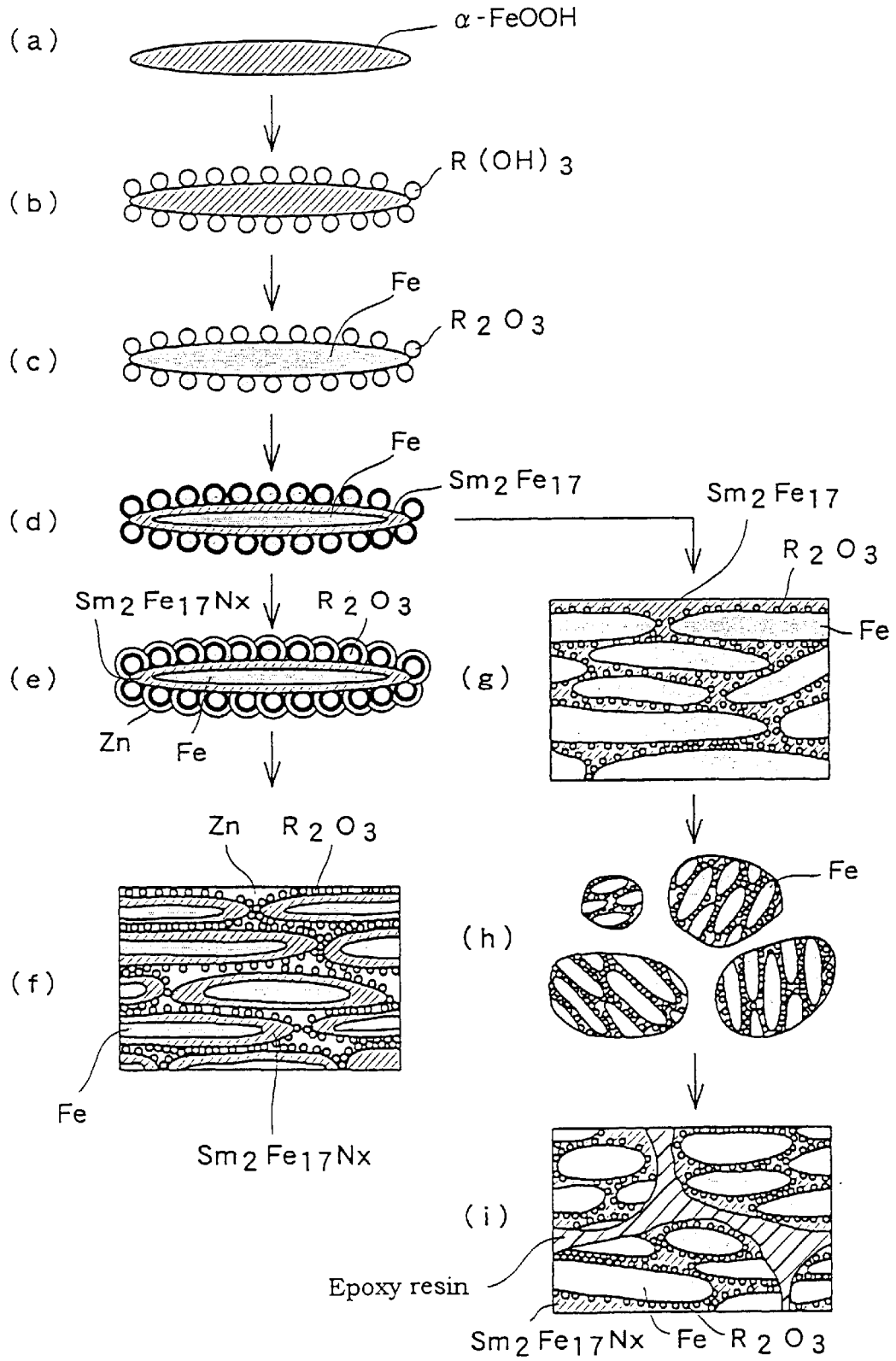
FIG. 1 is a diagram schematically showing a change of fine particles raw material from a magnet raw material to a magnet formed by the steps shown in FIG. 1.
Figure 2:
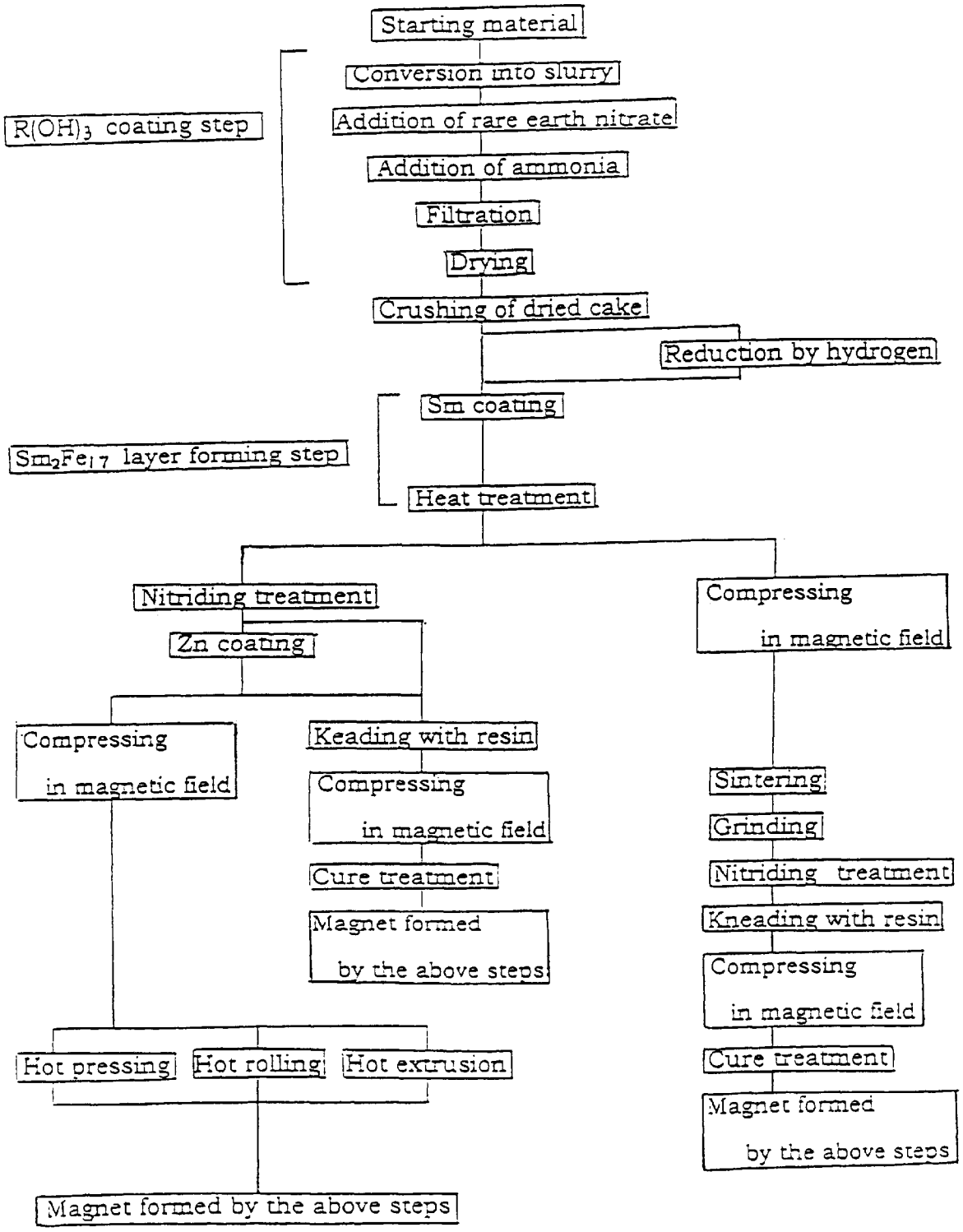
FIG. 2 is a diagram showing a flow of process from a magnet raw material to a magnet formed by the steps shown in FIG. 2.

A. Steps from Preparation of Raw Material to Formation of Zinc Coat Layer (1) Starting Material When needle-like Fe fine particles are used as a base material of a powder for magnet, TAROX synthetic iron oxide yellow LL-XLO, fine needle-like α-FeOOH fine particles having an average major axis of 0.7 μm and an average minor axis of 0.07 μm manufactured by Titan Kogyo Kabushiki Kaisha or fine needle-like electro-deposited Fe fine particles having a major axis of 0.5–1.0 μm and a minor axis of 0.03 μm obtained by electro-deposition of an iron salt solution using a mercury anode (U.S. Pat. No. 2,239,144)

were used as a raw material. When needle-like Fe—Co alloy fine particles are used as a base material of a powder for magnet, needle-like fine particles of $(Fe_{0.7}Co_{0.3})OOH$ obtained by adding ammonia water to a mixed aqueous solution of ferrous sulfate and cobalt sulfate in an atomic ratio Fe/Co of 70/30 at room temperature to coprecipitate Fe ions and Co ions in the form of $(Fe_{0.7}Co_{0.3})$ $(OH)_2$ and air-oxidizing $(Fe_{0.7}Co_{0.3})$ $(OH)_2$ in a solution at a temperature of 70° C. to form needle-like fine particles of $(Fe_{0.7}Co_{0.3})OOH$, followed by filtration and further drying were used as a raw material. A schematic diagram of the needle-like fine particles raw material is shown in FIG. 1(*a*). In addition, the contents of the respective steps of the following process are shown in FIG. 2 as a flow sheet.

(2) $R(OH)_3$ Coating Treatment

Hereinafter, the case of using α-FeOOH needle-like fine particles as a starting material will be described. 75 g of the α-FeOOH needle-like fine particles was fed into 1500 mililiter of pure water and the mixture was sufficiently stirred to obtain a suspension. A predetermined amount of a nitrate aqueous solution (concentration: 0.25 mol/liter) of a raw material for mish metal (Mm) (oxide mixture of La, Ce, Pr and Nd) or a $Nd(NO_3)_3$ aqueous solution (concentration: 0.25 mol/liter) was fed into the suspension and the mixture was further stirred for 1 hour until it is homogeneously mixed. Then, ammonia water was fed into this suspension with stirring continuously and the pH was made alkaline (pH of about 9) by further stirring for 2 hours. As a result, $Mm(OH)_3$ or $Nd(OH)_3$ (hereinafter referred to as $R(OH)_3$) was deposited on the surface of the α-FeOOH needle-like fine particles and the coating treatment was completed. A schematic diagram of the α-FeOOH needle-like fine particles with coating is shown in FIG. 1(*b*).

(3) Heat Treatment (reducing treatment)

The α-FeOOH needle-like fine particles coated with $R(OH)_3$ obtained as described above were filtered and dried, and the resultant dried cake was ground to obtain a raw material for reducing treatment. The raw material was fed into a vacuum rotary heat-treating reactor and subjected to a reducing treatment at a temperature of 500° C. for 1 hour with passing a hydrogen gas through the reactor at a rate of 3 liter per minute to obtain needle-like Fe fine particles coated with fine particles of $R_2O_3$. In this case, the fine particles raw material may also be heat-treated in an atmosphere before subjecting to the reducing treatment in order to coat with $R_2O_3$ more uniformly. A schematic diagram of the needle-like Fe fine particles coated with fine particles of $R_2O_3$ is shown in FIG. 1(*c*). In this Embodiment, since the α-FeOOH needle-like fine particles were used as the starting material, a hydrogen-containing gas must be used as the atmosphere on heat treatment in order to obtain needle-like Fe fine particles coated with an oxide of a rare earth element. When needle-like Fe fine particles are used as the starting material, a hydrogen-containing gas is not necessarily required, and an inert gas such as nitrogen, Ar or the like can also be used.

(4) Formation of Compound of Sm and Fe

Following the above steps, an Ar gas was introduced into the vacuum rotary heat-treating reactor and a predetermined amount of Sm powder was fed into the reactor. After the reactor was subjected to vaccum, a heat treatment was conducted at a temperature of 800° C. for 1 hour with rotating the reactor. As a result, the reactor was filled with vapor of Sm. Subsequently, the surface of the needle-like Fe fine particles was coated with Sm by slowly cooling. Then, an Ar gas was introduced into the reactor, and a heat treatment was conducted at a temperature of 800° C. for 3 hours. As a result, a solid phase reaction of Sm and Fe proceeded on the surface of the Fe fine particles to form a layer of $Sm_2Fe_{17}$ having a thickness of about 0.02 μm on the surface of the needle-like Fe fine particles. A schematic diagram of the needle-like Fe fine particles wherein a layer of $Sm_2Fe_{17}$ is formed on the surface is shown in FIG. 1(*d*).

(5) Nitriding Treatment and Zn Coating

Following the above steps, a nitriding treatment was conducted at a temperature of 500° C. for 3 hours with passing an ammonia gas through the reactor under an atmosphere while rotating the vacuum rotary heat-treating reactor. As a result, a $Sm_2Fe_{17}N_x$ layer was formed on the surface of the needle-like Fe fine particles. 10% by weight of Zn powder was fed into the reactor with passing an Ar gas through the reactor and, after the pressure of the reactor was decreased to $10^{-3}$ Torr, a heat treatment was conducted at a temperature of 400° C. for 1 hour with rotating the reactor. As a result, the reactor was filled with vapor of Zn. Subsequently, fine particles of $R_2O_3$ constituting the separation layer were coated with Zn by slowly cooling. A schematic diagram of the needle-like Fe fine particles is shown in FIG. 1(*e*). As a zinc coating treatment, for example, coating by photo-decomposition of zinc (zinc coating method of adding needle-like Fe particles to a diethylzinc/normal hexane solution and exposing to ultraviolet radiation, thereby decomposing diethylzinc to form metallic zinc) can be used, in addition to the above method. Furthermore, a low-melting point metal other than zinc (e. g. tin, lead, etc.) can also be used in combination.

B. Low Temperature Forming (1) EXAMPLE 1

The nitrided Zn-coated needle-like Fe fine particles made by the above steps A (1) to A(5) were pressed under a pressure of 2 ton/cm$^2$ with orienting in a magnetic field of 15 kOe to form a pellet-like one. Then, this pellet-like article was hot-pressed in an Ar gas atmosphere at a temperature of 420° C. under a pressure of 7 ton/cm$^2$ for 2 hours by using a hot press to obtain an object as shown in FIG. 1(*f*).

(2) EXAMPLE 2

The above pellet-like article was hot-rolled at a temperature of 300° C. by using a rolling mill so that the thickness would be 2 cm, and the resultant object was cut and ground to obtain an object as shown in FIG. 1(*f*).

(3) EXAMPLE 3

The above pellet-like article was hot-extruded at a temperature of 300° C. by using an extruder, and the resultant object was cut to obtain an object as shown in FIG. 1(*f*).

(4) EXAMPLE 4

The nitrided zinc-coated needle-like Fe fine particles made by the above steps A(1) to A(5) were mixed and kneaded with an epoxy resin (an amount of about 3% by weight to the fine particles raw material) and the mixture was pressed under a pressure of 2 ton/cm$^2$ with orienting in a magnetic field of 15 kOe, and then cured at a temperature of 120° C. for 1 hour to obtain a resin bonded permanent magnet.

2. Production of Magnet by Using Sintered Body Powder

(1) EXAMPLE 5

The needle-like Fe fine particles, wherein a layer of $Sm_2Fe_{17}$ is formed on the surface, made by the above steps A(1) to A(4) were pressed under a pressure of 2 ton/cm$^2$ with orienting in a magnetic field of 15 kOe, and then the pressed article was fed into an electric furnace and sintered in an Ar gas atmosphere at a temperature of 950° C. for 1 hour to obtain a sintered body as shown in FIG. 1(*g*). This sintered body was ground into particles having a size of 50 to 100 $\mu$m and then nitrided at a temperature of 500° C. for 3 hours with passing a nitrogen gas (an ammonia gas or a mixed gas of hydrogen and ammonia can also be used) through the furnace. As a result, a $Sm_2Fe_{17}N_x$ layer was formed on the surface of the needle-like Fe fine particles (FIG. 1(*h*)). The nitrided needle-like Fe fine particles sintered body powder was mixed and kneaded with an epoxy resin (an amount of about 2% by weight to the sintered body powder) and the mixture was pressed under a pressure of 2 ton/cm$^2$ with orienting in a magnetic field of 15 kOe, and then cured at a temperature of 120° C. for 1 hour to obtain a resin bonded permanent magnet as shown in FIG. 1(*i*).

3. Production of Magnet of Comparative Examples (1) COMPARATIVE EXAMPLE 1

The above fine needle-like α-FeOOH fine particles manufactured by Titan Kogyo Kabushiki Kaisha as the starting raw material were directly reduced in hydrogen atmosphere at a temperature of 500° C. without forming a separation layer and, after reducing, Sm—Fe compound layer was formed under the same conditions as described above. Then, the resultant compound was subjected to a nitriding treatment and Zn-coating treatment in the same manner as in Example 4 to make a resin bonded magnet.

(2) COMPARATIVE EXAMPLE 2

A 10% aluminum phosphate-ethanol solution was added to the above fine needle-like α-FeOOH fine particles manufactured by Titan Kogyo Kabushiki Kaisha as the starting raw material and ethanol was evaporated by heating, thereby to coat the fine particles with aluminum phosphate in the amount of 5% by mol to α-FeOOH. After reducing similarly, Sm—Fe compound layer was formed under the same conditions as described above and then a resin bonded magnet was made in the same manner as in Example 5.

4. Examination of Performances of Magnet

The magnet was made in the manner as described above. As the starting material, six kinds were employed as shown in Table 1 below. The results of analysis of metal element after formation of Sm—Fe compound layer are shown by atom ratio in Table 1. All of the resultant magnets were cut into pieces having a section of 10 mm×10 mm, and then performances of the respective magnets were determined by using a direct current BH tracer (manufactured by Toshiba Industries Co., Ltd.). The results are shown in Table 2 below.

TABLE 1

| Raw material No. | Starting material | Metal atom ratio after formation of Sm—Fe compound layer | | | | | | |
|---|---|---|---|---|---|---|---|---|
| | | Fe | Co | Sm | La* | Ce* | Pr* | Nd* |
| 1 | α-FeOOH | 97.5 | | 2.0 | 0.11 | 0.19 | 0.05 | 0.15 |
| 2 | (FeCo)OOH | 65.5 | 28.0 | 3.9 | — | — | — | 2.6 |
| 3 | (FeCo)OOH | 62.0 | 27.0 | 6.1 | — | — | — | 4.9 |
| 4 | Iron obtained by electro-deposition | 97.5 | — | 1.9 | 0.13 | 0.22 | 0.07 | 0.18 |
| 5 | Iron obtained by electro-deposition | 95.5 | — | 2.0 | — | — | — | 2.5 |

TABLE 1-continued

| Raw material No. | Starting material | Metal atom ratio after formation of Sm—Fe compound layer | | | | | | |
|---|---|---|---|---|---|---|---|---|
| | | Fe | Co | Sm | La* | Ce* | Pr* | Nd* |
| 6 | Iron obtained by electro-deposition | 93.0 | — | 2.0 | — | — | — | 5.0 |

Remarks
Element with mark* is derived from separation layer

TABLE 2

| Example No. | Raw material No. | Residual magnetic flux density (kG) | Coercive force (kOe) | BHmax (MGOe) |
|---|---|---|---|---|
| 1 (Hot pressing) | 1 | 16.8 | 9.2 | 56.0 |
| | 2 | 15.9 | 14.0 | 63.2 |
| | 3 | 13.5 | 12.8 | 42.2 |
| | 4 | 15.6 | 8.6 | 53.2 |
| | 5 | 15.5 | 14.4 | 62.6 |
| | 6 | 12.2 | 11.6 | 36.3 |
| 2 (Hot rolling) | 1 | 13.5 | 8.2 | 42.0 |
| | 2 | 10.6 | 9.6 | 30.5 |
| | 3 | 8.7 | 5.5 | 10.6 |
| | 4 | 12.8 | 8.4 | 40.6 |
| | 5 | 9.8 | 9.4 | 25.5 |
| | 6 | 7.5 | 4.2 | 8.6 |
| 3 (Hot extrusion) | 1 | 14.2 | 9.2 | 52.0 |
| | 2 | 13.8 | 10.6 | 55.0 |
| | 3 | 12.5 | 8.5 | 46.0 |
| | 4 | 13.5 | 8.8 | 51.8 |
| | 5 | 12.7 | 12.0 | 48.2 |
| | 6 | 10.9 | 9.6 | 40.4 |
| 4 (Resin bonding) | 1 | 12.3 | 7.2 | 20.6 |
| | 2 | 11.4 | 10.8 | 16.8 |
| | 3 | 9.7 | 9.6 | 11.2 |
| | 4 | 11.7 | 7.5 | 19.3 |
| | 5 | 10.6 | 9.6 | 13.9 |
| | 6 | 8.3 | 8.1 | 8.0 |
| 5 (Resin bonding after sintering) | 1 | 13.7 | 6.8 | 22.6 |
| | 2 | 12.7 | 9.6 | 25.3 |
| | 3 | 10.8 | 10.6 | 9.6 |
| | 4 | 12.9 | 6.9 | 11.2 |
| | 5 | 11.2 | 10.2 | 13.6 |
| | 6 | 9.6 | 9.3 | 8.9 |
| Comparative Example 1 | | 11.8 | 0.2 | <1 |
| Comparative Example 2 | | 10.5 | 0.8 | <1 |

As is apparent from Table 2, all magnets of these Examples exhibit excellent value in all of the residual magnetic flux density, coercive force and BHmax.

However, the magnet of Comparative Example 1 hardly exhibit magnetic performances because intragranular bonding and grain growth occurred on reducing treatment and heat treatment for forming Sm—Fe compound layer and an aspect ratio was reduced to 1–3.

Furthermore, regarding the magnet of Comparative Example 2, since a coat of aluminum phosphate is reduced by rare earth metals, effective rare earth metals in the sample were oxidized on sintering to cause volume swell, resulting in complete disintegration. That is, a bonded magnet was obtained, but the magnet hardly exhibits magnetic performances.

Industrial Applicability

Since the present invention is constructed as described above, there can be provided a powder for permanent magnet having excellent stable magnetic characteristics, a method for producing the powder, and anisotropic permanent magnet made by the powder.

What is claimed is:

1. A powder for a permanent magnet comprising fine particles with a major axis and a minor axis of 0.1 to 3 μm and 0.03 to 0.4 μm, respectively, of an Fe or Fe—Co alloy as a base material, a hard magnetic layer containing Fe, Sm and N provided on a surface of said fine particles, and a separation layer of an oxide of R provided outside said hard magnetic layer, wherein R represents one or more rare earth elements selected from the group consisting of Nd, La, Ce, Pr, Sm, and Y.

2. A powder for a permanent magnet comprising a sintered body powder having a particle diameter of 10 to 100 μm, said sintered body powder comprising fine particles with a major axis and a minor axis of 0.1 to 3 μm and 0.03 to 0.4 μm, respectively, of an Fe or Fe—Co alloy as a base material, a hard magnetic layer containing Fe, Sm, and N provided on a surface of said fine particles, and a separation layer of an oxide of R provided outside said hard magnetic layer, wherein R represents one or more rare earth elements selected from the group consisting of Nd, La, Ce, Pr, Sm, and Y.

3. The powder for permanent magnet according to claim 1, wherein the separation layer is further coated with one or more metals selected from the group consisting of Zn, Sn, and Pb.

4. A method for producing a powder for a permanent magnet, which comprises coating a surface of Fe fine particles or Fe—Co alloy fine particles, said fine particles having a major axis of 0.1 to 3 μm and a minor axis of 0.03 to 0.4 μm, with a hydroxide of R by a wet deposition method;

subjecting the fine particles to filtration and drying;

heat-treating the dried fine particles in an atmosphere of a hydrogen gas, an inert gas, or a mixture thereof;

coating the resultant Fe fine particles or Fe—Co alloy fine particles coated with an oxide of R with Sm in a vacuum at a temperature of 500 to 1000° C.;

further heat-treating the fine particles to form a compound layer containing Fe and Sm on the surface of the Fe fine particles or Fe—Co alloy fine particles;

and subjecting the heat-treated fine particles to a nitriding treatment in a nitrogen-containing gas;

wherein R represents one or more rare earth elements selected from the group consisting of Nd, La, Ce, Pr, Sm, and Y.

5. A method for producing a powder for permanent magnet, which comprises coating a surface of α-FeOOH fine particles or α-FeOOH fine particles doped with Co, said fine particles having a major axis of 0.1 to 3 μm and a minor axis of 0.03 to 0.4 μm, with a hydroxide of R by a wet deposition method;

subjecting the fine particles to filtration and drying;

heat-treating the dried fine particles in an atmosphere of a hydrogen-containing gas;

coating the resultant Fe fine particles or Fe—Co alloy fine particles coated with an oxide of R with Sm in a vacuum at a temperature of 500 to 1000° C.;

further heat-treating the fine particles to form a compound layer containing Fe and Sm on the surface of the Fe fine particles or Fe—Co alloy fine particles;

and subjecting the heat-treated fine particles to a nitriding treatment in a nitrogen-containing gas;

wherein R represents one or more rare earth elements selected from the group consisting of Nd, La, Ce, Pr, Sm, and Y.

6. A method for producing a powder for a permanent magnet, which comprises coating a surface of Fe fine particles or Fe—Co alloy fine particles, said fine particles having a major axis of 0.1 to 3 μm and a minor axis of 0.03 to 0.4 μm, with a hydroxide of R by a wet deposition method;

subjecting the fine particles to filtration and drying;

heat-treating the dried fine particles in an atmosphere of a hydrogen gas, an inert gas, or a mixture thereof;

coating the resultant Fe fine particles or Fe—Co alloy fine particles coated with an oxide of R with Sm in a vacuum at a temperature of 500 to 1000° C.;

further heat-treating the fine particles to form a compound layer containing Fe and Sm on the surface of the Fe fine particles or Fe—Co alloy fine particles;

compressing the fine particle in a magnetic field to form a compressed article;

sintering the compressed article at a temperature of 700 to 1000° C.;

grinding the sintered article into particles having a particle diameter of 10 to 100 μm;

and subjecting the particles to a nitriding treatment in a nitrogen-containing gas;

wherein R represents one or more rare earth elements selected from the group consisting of Nd, La, Ce, Pr, Sm, and Y.

7. A method for producing a powder for a permanent magnet, which comprises coating α-FeOOH fine particles or α-FeOOH fine particles doped with Co, said fine particles having a major axis of 0.1 to 3 μm and a minor axis of 0.03 to 0.4 μm, with a hydroxide of R by a wet deposition method;

subjecting the fine particles to filtration and drying;

heat-treating the dried fine particles in an atmosphere of a hydrogen-containing gas;

coating the resultant Fe fine particles or Fe—Co alloy fine particles coated with an oxide of R with Sm in a vacuum at a temperature of 500 to 1000° C.;

further heat-treating the fine particles to form a compound layer containing Fe and Sm on the surface of the Fe fine particles or Fe—Co alloy fine particles;

compressing the fine particle in a magnetic field to form a compressed article;

sintering the compressed article at a temperature of 700 to 1000° C.;

grinding the sintered article into particles having a particle diameter of 10 to 100 μm;

and subjecting the particles to a nitriding treatment in a nitrogen-containing gas;

wherein R represents one or more rare earth elements selected from the group consisting of Nd, La, Ce, Pr, Sm, and Y.

8. The method according to claim 5, wherein the step of coating the surface with one or more metals of Zn, Sn, and Pb is conducted after the nitriding treatment.

9. An anisotropic permanent magnet which is obtained by kneading a powder for a permanent magnet, said powder comprising fine particles with a major axis and a minor axis of 0.1 to 3 μm and 0.03 to 0.4 μm, respectively, of Fe or Fe—Co alloy as a base material, a hard magnetic layer containing Fe, Sm, and N provided on the surface of said fine particles, and a separation layer of an oxide of R provided outside said hard magnetic layer, with a resin; and hot-pressing the resulting mixture in a magnetic field;

wherein R represents one or more rare earth elements selected from the group consisting of Nd, La, Ce, Pr, Sm, and Y.

10. An anisotropic permanent magnet which is obtained by kneading a powder for permanent magnet comprising a sintered body powder having a particle diameter of 10 to 100 μm, said sintered body powder comprising fine particles with a major axis and a minor axis of 0.1 to 3 μm and 0.03 to 0.4 μm, respectively, of Fe or Fe—Co alloy as a base material, a hard magnetic layer containing Fe, Sm, and N provided on the surface of said fine particles, and a separation layer of an oxide of R provided outside said hard magnetic layer, with a resin; and hot-pressing the resulting mixture in a magnetic field;

wherein R represents one or more rare earth elements selected from the group consisting of Nd, La, Ce, Pr, Sm, and Y.

11. An anisotropic permanent magnet which is obtained by kneading a powder for permanent magnet, said powder comprising fine particles with a major axis and a minor axis of 0.1 to 3 μm and 0.03 to 0.4 μm, respectively, of Fe or Fe—Co alloy as a base material, a hard magnetic layer containing Fe, Sm, and N provided on the surface of said fine particles, and a separation layer of an oxide of R provided outside said hard magnetic layer, the separation layer being coated with one or more metals of Zn, Sn, and Pb, with a resin; and hot-pressing the resulting mixture in a magnetic field;

wherein R represents one or more rare earth elements selected from the group consisting of Nd, La, Ce, Pr, Sm, and Y.

12. An anisotropic permanent magnet which is obtained by hot-pressing a powder for permanent magnet comprising fine particles with a major axis and a minor axis of 0.1 to 3 μm and 0.03 to 0.4 μm, respectively, of Fe or Fe—Co alloy as a base material, a hard magnetic layer containing Fe, Sm, and N provided on the surface of said fine particles, and a separation layer of an oxide of R provided outside said hard magnetic layer, the separation layer being coated with one or more metals of Zn, Sn, and Pb, using the metal as a binder;

wherein R represents one or more rare earth elements selected from the group consisting of Nd, La, Ce, Pr, Sm, and Y.

13. The method according to claim 4 wherein after the nitriding treatment the surface is further coated with one or more metals of Zn, Sn, and Pb.

* * * * *